US010789879B1

(12) United States Patent
Iguchi

(10) Patent No.: US 10,789,879 B1
(45) Date of Patent: Sep. 29, 2020

(54) LIGHT EMITTING DEVICE

(71) Applicant: FUJI XEROX CO., LTD., Tokyo (JP)

(72) Inventor: Daisuke Iguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/719,932

(22) Filed: Dec. 18, 2019

(30) Foreign Application Priority Data

Jun. 19, 2019 (JP) ..... 2019-113581

(51) Int. Cl.
*G09G 3/32* (2016.01)

(52) U.S. Cl.
CPC ..... *G09G 3/32* (2013.01); *G09G 2300/0852* (2013.01)

(58) Field of Classification Search
CPC ..... G09G 3/32; G09G 2300/0852
See application file for complete search history.

(56) References Cited

U.S. PATENT DOCUMENTS 5,635,767 A * 6/1997 Wenzel ..... H01L 23/642 257/691
2002/0181185 A1* 12/2002 Kabumoto ..... H01L 23/49838 361/306.3
2004/0012085 A1* 1/2004 Shioga ..... H01L 27/016 257/723
2004/0047112 A1* 3/2004 Yoshida ..... H01G 11/48 361/523
2004/0075127 A1* 4/2004 Yamasaki ..... H01L 27/13 257/298
2004/0087058 A1* 5/2004 Ooi ..... H01L 23/49822 438/106
2004/0125543 A1* 7/2004 Hirano ..... H05K 1/186 361/523
2004/0238941 A1* 12/2004 Satoh ..... H05K 1/162 257/698
2005/0185382 A1* 8/2005 Ooi ..... H01L 23/49894 361/718
2006/0182941 A1* 8/2006 Yano ..... C08J 5/005 428/292.1
2006/0217909 A1* 9/2006 Uriu ..... G06F 30/367 702/65
2006/0261482 A1* 11/2006 Jow ..... H05K 1/0268 257/758
2007/0121273 A1* 5/2007 Yamamoto ..... H05K 1/0231 361/306.2
2007/0152339 A1* 7/2007 Jow ..... G01R 31/2818 257/758
2007/0164396 A1* 7/2007 Jow ..... H01G 4/40 257/532

(Continued)

FOREIGN PATENT DOCUMENTS

JP 2012178519 9/2012

*Primary Examiner* — Michael Pervan
(74) *Attorney, Agent, or Firm* — JCIPRNET

(57) ABSTRACT

A light emitting device includes a board, a light emitting element that is provided on the board, a drive element that is provided on the board and drives the light emitting element, and drive wiring that is provided on the board and connects the light emitting element to the drive element, and a capacitive element that is provided inside the board such that at least a part of the capacitive element overlaps the drive wiring in plan view, and supplies a drive current to the light emitting element via internal wiring which is inside the board and faces the drive wiring.

20 Claims, 3 Drawing Sheets

(56) References Cited

U.S. PATENT DOCUMENTS

2007/0222031 A1* 9/2007 Jow ..... H05K 1/162
257/532
2008/0030968 A1* 2/2008 Mashino ..... H01G 4/33
361/767
2008/0185614 A1* 8/2008 Gamand ..... H01L 23/50
257/203
2008/0239685 A1* 10/2008 Kawabe ..... H01L 23/50
361/782
2008/0277150 A1* 11/2008 Takashima ..... H01L 21/4857
174/260
2008/0291649 A1* 11/2008 Mashino ..... H01L 23/49827
361/763
2009/0123726 A1* 5/2009 Yano ..... B82Y 30/00
428/292.1
2011/0018144 A1* 1/2011 Horiuchi ..... H05K 3/4605
257/784
2012/0081861 A1* 4/2012 Shimada ..... H01L 24/16
361/737
2012/0257323 A1* 10/2012 Hayakawa ..... H01L 23/642
361/301.4
2012/0287586 A1* 11/2012 Mikado ..... H01L 23/50
361/748
2018/0233291 A1* 8/2018 Suzuki ..... H01G 4/012

* cited by examiner

LIGHT EMITTING DEVICE

CROSS-REFERENCE TO RELATED APPLICATIONS

This application is based on and claims priority under 35 USC 119 from Japanese Patent Application No. 2019-113581 filed Jun. 19, 2019.

BACKGROUND

(i) Technical Field

The present invention relates to a light emitting device.

(ii) Related Art

An optoelectric mixed package with a built-in capacitor including a core board that has a main surface and aback surface and has a housing hole portion which is open on at least a main surface side, a capacitor that is formed in a plate shape having a first main surface and a second main surface and is housed in the housing hole portion, a resin filler that fills a gap between an inner wall surface of the housing hole portion and the capacitor, and a wiring laminated portion that is formed by alternately laminating an inter-resin layer insulation layer and a conductor layer onto the main surface of the core board and the first main surface of the capacitor is disclosed in JP2012-178519A. In the optoelectric mixed package with a built-in capacitor, an LSI mounting region onto which an LSI for processing an electric signal is mounted, an optical element mounting region onto which an optical element performing signal conversion between an electric signal and an optical signal is mounted, and an optical element controlling IC mounting region onto which an optical element controlling IC for controlling an optical element is mounted are set on the wiring laminated portion. A signal transmitting wiring path for electrically connecting the LSI and the optical element controlling IC to each other, a first power supply stabilizing wiring path for electrically connecting the LSI and the capacitor to each other, and a second power supply stabilizing wiring path for electrically connecting the optical element controlling IC and the capacitor to each other are formed in the wiring laminated portion.

SUMMARY

Aspects of non-limiting embodiments of the present disclosure relate to a light emitting device in which an inductance of a drive circuit is reduced compared to a configuration where a capacitive element that supplies a drive current to a light emitting element is provided on a board.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light emitting device includes a board, a light emitting element that is provided on the board, a drive element that is provided on the board and drives the light emitting element, and drive wiring that is provided on the board and connects the light emitting element to the drive element, and a capacitive element that is provided inside the board such that at least a part of the capacitive element overlaps the drive wiring in plan view, and supplies a drive current to the light emitting element via internal wiring which is inside the board and faces the drive wiring.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the present invention will be described in detail with reference to the drawings.

Figure 1A:
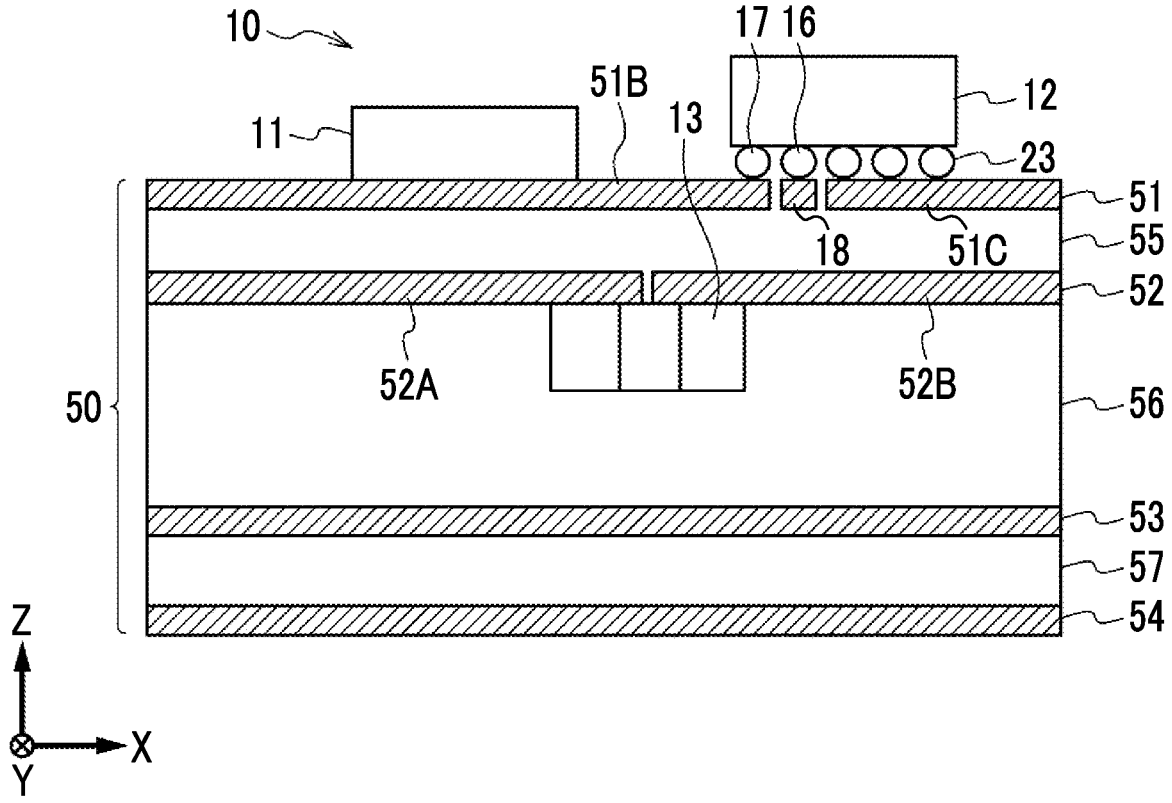
FIG. 1A is a sectional view illustrating an example of a configuration of a light emitting device according to an exemplary embodiment.
Figure 1B:
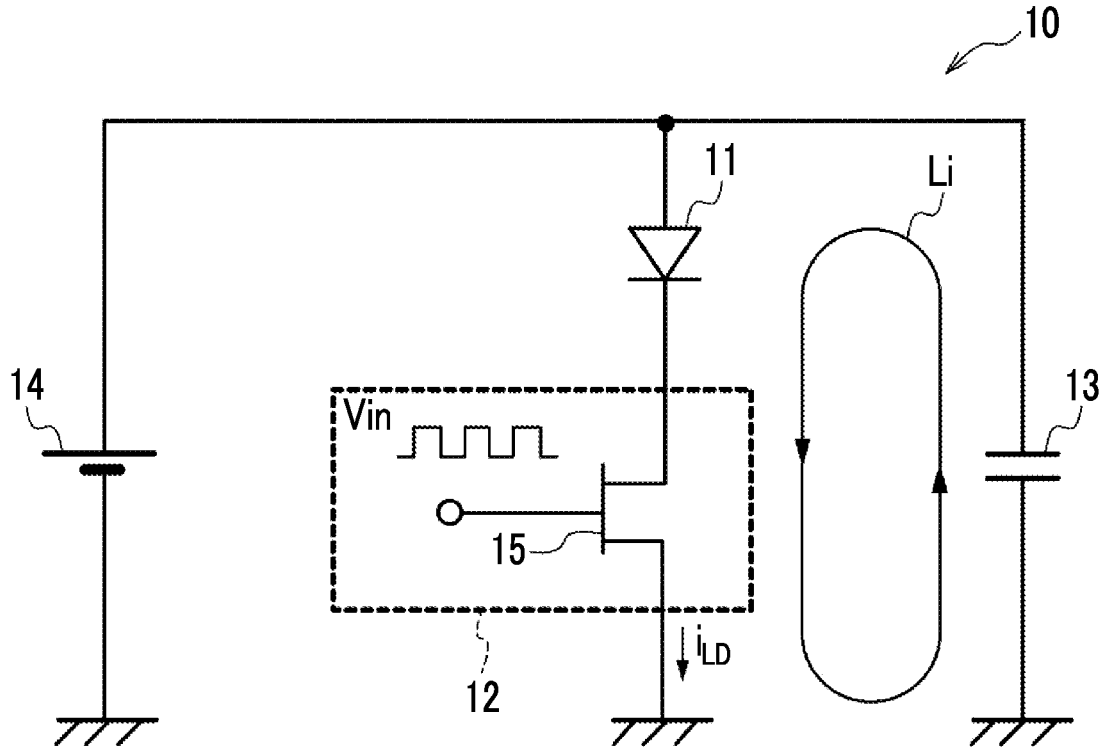
FIG. 1B is a circuit diagram of the light emitting device.
Figure 2:
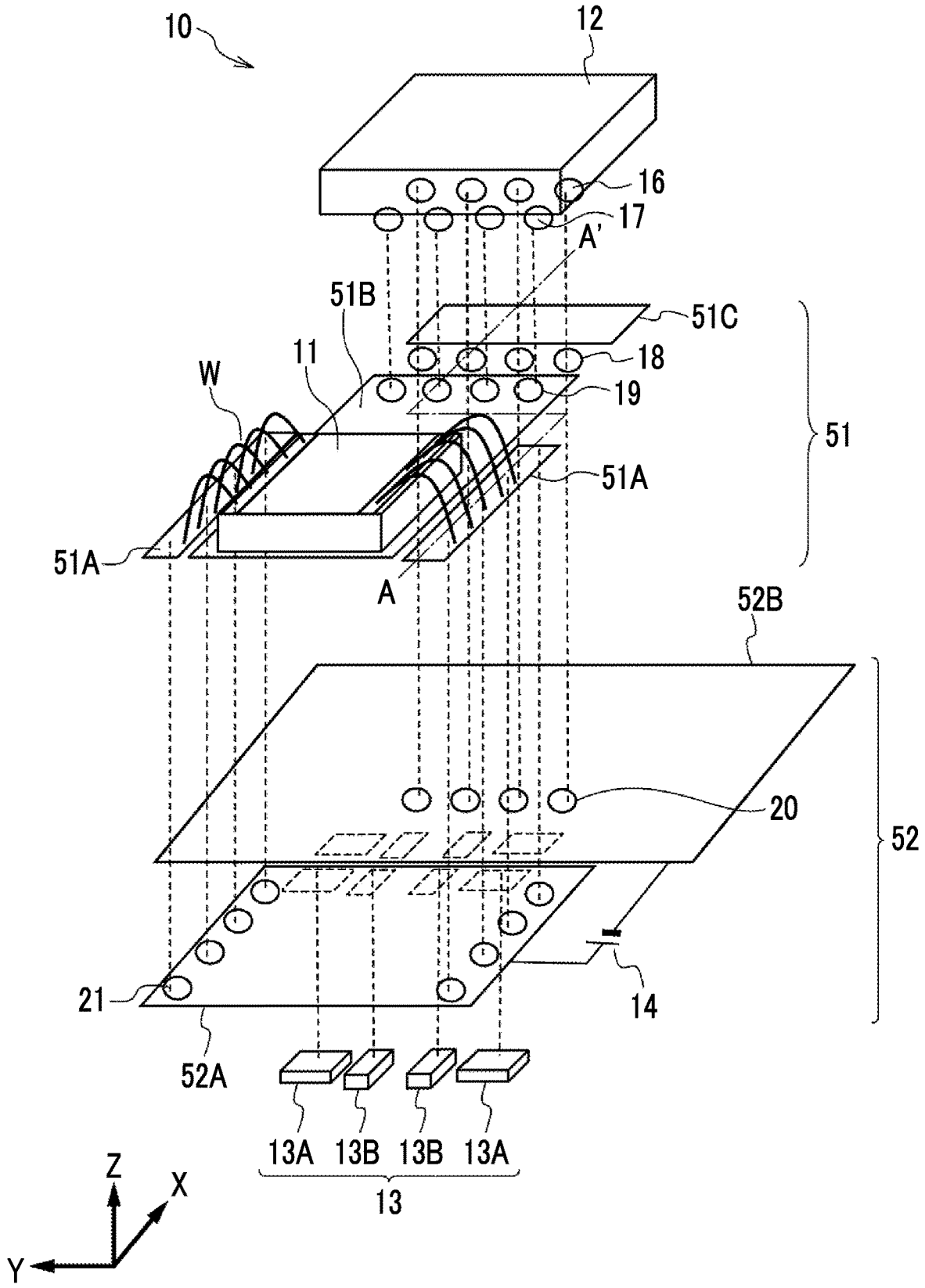
FIG. 2 is an exploded perspective view for illustrating the configuration of the light emitting device according to the exemplary embodiment.
Figure 3:
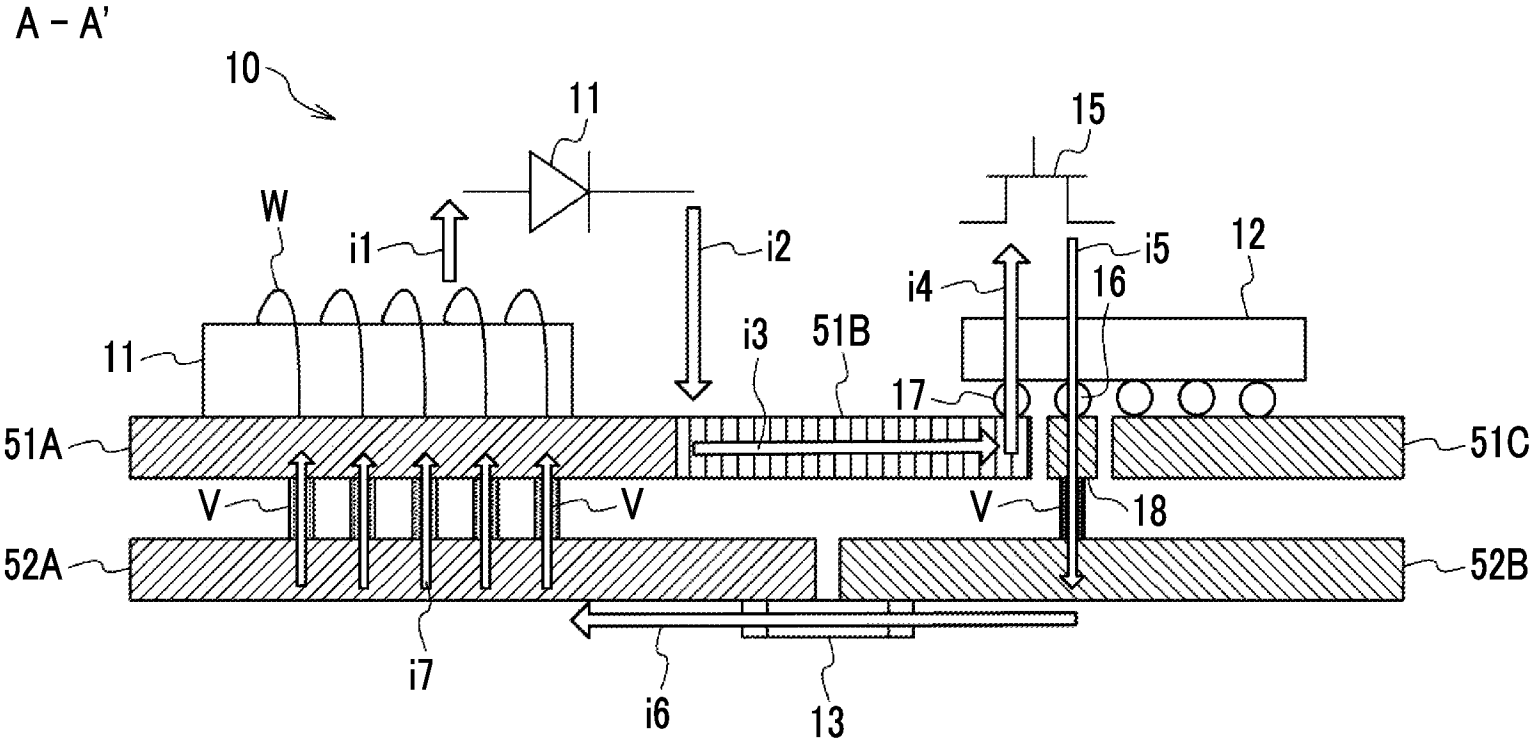
FIG. 3 is a sectional view for illustrating a drive current loop of the light emitting device according to the exemplary embodiment.

A light emitting device 10 according to the exemplary embodiment will be described with reference to FIGS. 1A to 3. FIG. 1A is a sectional view of the light emitting device 10 according to the exemplary embodiment, and FIG. 1B is a circuit diagram of the light emitting device 10. FIG. 2 is an exploded perspective view for illustrating a configuration of the light emitting device 10 in detail, and the sectional view in FIG. 1A is a sectional view of the light emitting device 10 taken along an X-axis direction near the center in a Y-axis direction in FIG. 2. FIG. 3 is a sectional view illustrating a drive current loop in the light emitting device 10, and is a sectional view taken along line A-A' in the exploded perspective view in FIG. 2.

As illustrated in FIG. 1A, the light emitting device 10 is configured to include a board 50, a light emitting element 11, and a drive element 12.

The board 50 according to the exemplary embodiment is configured as a printed board with multiple layers (a case of four layers is given as an example in FIG. 1A) using, for example, a glass epoxy resin. In addition, a capacitor 13 is disposed (buried) inside the board 50. The "capacitor 13" is an example of a "capacitive element" according to the exemplary embodiment of the present invention.

The light emitting element 11 according to the exemplary embodiment is a part that generates light to be emitted from the light emitting device 10, and is configured, for example, by using a surface-emitting semiconductor laser (vertical cavity surface emitting laser (VCSEL)).

The drive element 12 is an element that drives the light emitting element 11 to emit light, and is configured, for example, by a semiconductor integrated circuit.

As illustrated in FIG. 1A, the board 50 includes, as four wiring layers, a first wiring layer 51, a second wiring layer 52, a third wiring layer 53, and a fourth wiring layer 54. The capacitor 13 is disposed in the second wiring layer 52. A prepreg layer 55 is disposed between the first wiring layer 51 and the second wiring layer 52, a core layer 56 is disposed between the second wiring layer 52 and the third wiring layer 53, and a prepreg layer 57 is disposed between the third wiring layer 53 and the fourth wiring layer 54. Hereinafter, a surface on which the first wiring layer 51 of the board 50 is formed is referred to as a "circuit surface", and a layer below the circuit surface (a side of a −Z-direction) is referred to as an "inner layer" in some cases.

As will be described later, the first wiring layer 51 is divided into a cathode pattern 51B, a GND pad 18, and a circuit pattern 51C, and the second wiring layer 52 is divided into an anode pattern 52A and a GND pattern 52B. The anode pattern 52A is connected to an anode of the light emitting element 11, and the GND pattern 52B is connected to ground of the light emitting device 10.

As illustrated in FIG. 1A, each of the light emitting element 11 and the drive element 12 is mounted on one surface of the board 50. As will be described later, a bottom surface of the light emitting element 11 becomes a cathode, and in the exemplary embodiment, the cathode is connected to the first wiring layer 51 via the cathode pattern 51B, for example, by soldering. The drive element 12 includes, for example, a solder ball 23 as an external connecting terminal, and is connected to the first wiring layer 51 by the solder ball 23.

The third wiring layer 53 and the fourth wiring layer 54 are used in wiring for a control signal with respect to the light emitting element 11 or the drive element 12. A cathode connecting terminal 17 and a GND connecting terminal 16 will be described later.

Next, an electrical configuration of the light emitting device 10 will be described with reference to FIG. 1B. FIG. 1B illustrates only transistor 15, which is on the final stage, supplies a current to the light emitting element 11 as the drive element 12. Although a MOS transistor is given as an example of the transistor 15 in FIG. 1B, the transistor 15 may be a bipolar transistor. A pulse signal Vin is input into a gate of the transistor 15, and the light emitting element 11 is driven, for example, by a pulse current corresponding to the pulse signal Vin. As illustrated in FIG. 1B, the light emitting element 11 and the transistor 15 are connected to each other in series, and a power supply 14 is connected to the series circuit in parallel. The power supply 14 supplies a drive current iLD to the light emitting element 11. On the other hand, the capacitor 13 is equivalently connected to the series circuit of the light emitting element 11 and the transistor 15 in parallel. The reference sign Li indicates a drive current loop that supplies the drive current iLD to the light emitting element 11, and details of the drive current loop Li will be described later.

These days, a VCSEL having high light output power, which is used in a time of flight (TOF) measuring device and the like, has wider application. That is, the VCSEL of these days is required to be driven by a large current in some cases. As can be seen from mobile devices, miniaturization of a device on which a measuring device is mounted is required. As a result, also a light emitting device used in the measuring device is required to be greatly miniaturized by approximately several mm degrees. In addition, high-speed driving at approximately several hundreds of MHz is required for the TOF measuring device due to measurement accuracy. In short, the VCSEL of these days is required to be capable of driving a current having an amplitude of ampere (A) order in a rise time of several hundreds of picoseconds (ps) in some cases.

As mainly described above, the light emitting device 10 according to the exemplary embodiment is configured as a light emitting device including a high-speed driving and high light output power VCSEL. For this reason, a configuration where a decoupling capacitor (the capacitor 13) having a large capacity value is disposed in the power supply and a drive current is supplied from the decoupling capacitor is adopted in the light emitting device 10. In such a configuration, it is necessary to reduce an inductance component in a drive current path as much as possible in order to increase optical output power from the VCSEL. Details of an inductance component reducing method in the exemplary embodiment will be described later.

The configuration of the light emitting device 10 according to the exemplary embodiment will be described in further detail with reference to FIG. 2. FIG. 2 is a view illustrating the first wiring layer 51 and the second wiring layer 52 selected from the wiring layers of the board 50 illustrated in FIG. 1A.

As illustrated in FIG. 2, the first wiring layer 51 is configured to include an anode pattern 51A, the cathode pattern 51B, and the circuit pattern 51C. The "cathode pattern 51B" is an example of "drive wiring" according to the exemplary embodiment of the present invention.

The anode pattern 51A is a wiring pattern connected to the anode of the light emitting element 11. An upper surface of the light emitting element 11 according to the exemplary embodiment is an almost full surface anode except for a light emitting port. For this reason, the upper surface of the light emitting element 11 is connected to the anode pattern 51A by a plurality of bonding wires W. As illustrated in FIG. 2, the bonding wires W are disposed along an extending direction of the anode pattern 51A. Although a form of connecting the bonding wires W in two directions of the upper surface of the light emitting element 11 is given as an example in the exemplary embodiment, connection may be performed in one direction or three directions without being limited to two directions.

The anode pattern 51A is connected to an anode seat 21 of the anode pattern 52A through a via (not illustrated). The "seat" in the exemplary embodiment does not have a pattern having a specific shape but refers to a region where the via or the like comes into contact.

As described above, the cathode pattern 51B is connected to the bottom surface of the light emitting element 11. In addition, the cathode pattern 51B is connected to the cathode connecting terminal 17 (solder ball) of the drive element 12 via a cathode seat 19. As illustrated in FIG. 2, the anode pattern 51A extends from a light emitting element 11 side to a drive element 12 side along the cathode pattern 51B.

The circuit pattern 51C is a pattern for connecting a connecting terminal (not illustrated) other than the GND connecting terminal 16 and the cathode connecting terminal 17 of the drive element 12.

The GND pad 18 is connected to the GND connecting terminal 16 (solder ball) of the drive element 12. The GND pad 18 is connected to a GND seat 20 of the GND pattern 52B through a via V (refer to FIG. 3).

As illustrated in FIG. 2, in the light emitting device 10 according to the exemplary embodiment, the capacitor 13 is disposed to connect the anode pattern 52A to the GND pattern 52B. In the exemplary embodiment, as the capacitor 13, a low equivalent series inductance (ESL) capacitor 13A and a normal (not low ESL) capacitor 13B are used in combination. Reasons for using in combination will be described later.

As described above, in the light emitting device 10 according to the exemplary embodiment, it is necessary to reduce the impedance of a path of the drive current iLD, that is, a loop of the VCSEL (anode)—the VCSEL (cathode)—a constant current transistor (the transistor 15)—a GND—the decoupling capacitor (the capacitor 13)—the VCSEL (anode). That is, in order to cause a rise in a large drive current at a high speed, it is necessary to make sure that a rise in the drive current does not slow down by reducing an inductance component as much as possible. Specifically, the inductance component in the loop is required to be equal to or lower than, for example, approximately 0.5 nH.

Consequently, in the present invention, a length of the drive current loop Li, which is the loop of the drive current iLD illustrated in FIG. 1B, is made short, and a volume of the drive current loop Li is made as small as possible. In other words, the drive current loop Li is made as small as possible. In addition, as one means for realizing the configuration, the capacitor 13 is provided on the inner layer of the board 50.

Types of the capacitor 13 are also considered in the light emitting device 10 according to the exemplary embodiment. That is, as described above, the low ESL capacitor 13A and the normal capacitor 13B are used in the exemplary embodiment. The low ESL capacitor 13A has a small parasitic inductance component, but a capacity value thereof cannot be made that large. On the other hand, the normal capacitor 13B has a large capacity value compared to the capacitor 13A, but an inductance component thereof is relatively large.

Thus, in the exemplary embodiment, a configuration where the capacitor 13A is used in supplying the drive current iLD having a relatively high frequency component included in a rise in the pulse signal Vin and the capacitor 13B is used in supplying the drive current iLD having a relatively low frequency component of other than a rise in the pulse signal Vin is adopted. In addition, in order to supply the drive current iLD having a relatively high frequency component from the capacitor 13A, the capacitor 13A may be disposed at a position closer to the bonding wires W than the capacitor 13B is.

The configuration of the light emitting device 10 according to the exemplary embodiment will be described in further detail with reference to FIG. 3. FIG. 3 is a sectional view taken along line A-A' in FIG. 2, and illustrates the drive current loop Li of the VCSEL (anode)—the VCSEL (cathode)—the constant current transistor (the transistor 15)—the GND—the decoupling capacitor (the capacitor 13)—the VCSEL (anode).

In FIG. 3, according to a position of the drive current iLD, the drive current is assigned with the reference signs i1 to i7 for convenience of description. That is, each of current values of i1 to i7 corresponds to iLD. The current i1 input into the anode of the light emitting element 11 goes through the cathode as the current i2, and flows in the cathode pattern 51B as the current i3. The current i3 goes through the cathode connecting terminal 17, is input into one terminal of the transistor 15 as the current i4, and is output from the other terminal as the current i5. The current i5 goes through the GND connecting terminal 16, the GND pad 18, and the via V, and flows in the GND pattern 52B, the capacitor 13, and the anode pattern 52A as the current i6. The current i6 flows in the via V, the anode pattern 51A, the bonding wires W as the current i7, and returns to the anode of the light emitting element 11.

As it is clear from the description above, the light emitting device 10 is configured such that an occupied volume of the drive current loop Li configured by the currents i1 to i7 is as small as possible by using the first wiring layer 51 and the second wiring layer 52.

In addition, in the drive current loop Li according to the exemplary embodiment, a phase of the drive current iLD (that is, the current i3), which is a pulse signal flowing in the first wiring layer 51, and a phase of the drive current iLD (that is, the current i6), which is a pulse signal flowing in the second wiring layer 52, are opposite phases to each other. The configuration also contributes to making an inductance component of the drive current loop Li smaller. That is, in a case where an inductance of a circuit configured on a first wiring layer 51 side is set as L1, an inductance of a circuit configured on a second wiring layer 52 side is set as L2, and a mutual inductance of both is set as Lm, an effective inductance Leff is acquired through the following (Equation 1).

$$Leff=(L1+L2)-2\times Lm \quad \text{(Equation 1)}$$

At this time, since the mutual inductance Lm increases by making a phase of the drive current iLD flowing in the first wiring layer 51 and a phase of the drive current iLD flowing in the second wiring layer 52 opposite phases to each other, the effective inductance Leff decreases.

Although the light emitting device 10 according to the exemplary embodiment has a characteristic in which the capacitor 13 is disposed in the second wiring layer 52 as described above, other characteristics will be described as follows.

First, the capacitor 13 is provided inside the board 50 such that at least a part thereof overlaps the cathode pattern 51B in plan view, and supplies the drive current iLD to the light emitting element 11 via internal wiring which is inside the board 50 and faces the cathode pattern 51B. In this case, the entire capacitor 13 may be disposed to overlap the cathode pattern 51B. In addition, in a case where the capacitor 13 is configured by a plurality of capacitors, at least some or all of the plurality of capacitors may be disposed to overlap the cathode pattern 51B.

On the other hand, in a case where the capacitor 13 is configured by the low ESL capacitor 13A and the normal capacitor 13B, as described above, in order to supply the drive current iLD having a relatively high frequency component from the capacitor 13A, the capacitor 13A may be disposed at the position closer to the bonding wires W than the capacitor 13B is. Alternatively, to further generalize the disposition, the capacitor 13A may be provided at a position closer to a path of the drive current iLD flowing from above the board 50 to the internal wiring than the capacitor 13B is.

In addition, the capacitor 13 may be disposed such that at least a part thereof overlaps at least one of the light emitting element 11 or the drive element 12 in plan view (a case where the capacitor is disposed such that the entire part thereof does not overlap both of the light emitting element 11 and the drive element 12 is given as an example in FIG. 3). By disposing the capacitor 13 in this manner, the light emitting device 10 is miniaturized further. As illustrated in FIG. 1A, the capacitor 13 may be disposed on a surface of the second wiring layer 52 on an inner layer side. In the configuration, the light emitting device 10 is miniaturized further than a case where the capacitor 13 is disposed on a circuit surface side of the second wiring layer 52.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light emitting device comprising:

a board;

a light emitting element that is provided on the board, a drive element that is provided on the board and drives the light emitting element, and drive wiring that is provided on the board and connects the light emitting element to the drive element; and a capacitive element that is provided inside the board such that at least a part of the capacitive element overlaps the drive wiring in plan view, and supplies a drive current to the light emitting element via internal wiring which is inside the board and faces the drive wiring.

2. The light emitting device according to claim 1, wherein the capacitive element is provided inside the board so as to fully overlap the drive wiring in plan view.

3. The light emitting device according to claim 2, wherein the drive wiring is provided in a first wiring layer formed on a surface of the board, and the internal wiring is provided in a second wiring layer inside the board adjacent to the first wiring layer.

4. The light emitting device according to claim 3, wherein the capacitive element is connected to the internal wiring on an inner layer side of the second wiring layer.

5. The light emitting device according to claim 1, wherein the capacitive element includes a plurality of capacitive elements, and the plurality of capacitive elements are provided inside the board such that at least some of the plurality of capacitive elements overlap the drive wiring.

6. The light emitting device according to claim 5, wherein the plurality of capacitive elements are provided inside the board such that all of the plurality of capacitive elements overlap the drive wiring.

7. The light emitting device according to claim 6, wherein the drive wiring is provided in a first wiring layer formed on a surface of the board, and the internal wiring is provided in a second wiring layer inside the board adjacent to the first wiring layer.

8. The light emitting device according to claim 7, wherein the capacitive element is connected to the internal wiring on an inner layer side of the second wiring layer.

9. The light emitting device according to claim 5, wherein the drive wiring is provided in a first wiring layer formed on a surface of the board, and the internal wiring is provided in a second wiring layer inside the board adjacent to the first wiring layer.

10. The light emitting device according to claim 9, wherein the capacitive element is connected to the internal wiring on an inner layer side of the second wiring layer.

11. The light emitting device according to claim 1, wherein the capacitive element includes a first capacitive element and a second capacitive element having an equivalent series inductance larger than an equivalent series inductance of the first capacitive element, and the first capacitive element is provided at a position closer to a path of a drive current flowing from above the board to the internal wiring than the second capacitive element is.

12. The light emitting device according to claim 11, wherein the drive wiring is provided in a first wiring layer formed on a surface of the board, and the internal wiring is provided in a second wiring layer inside the board adjacent to the first wiring layer.

13. The light emitting device according to claim 12, wherein the capacitive element is connected to the internal wiring on an inner layer side of the second wiring layer.

14. The light emitting device according to claim 1, wherein the capacitive element is provided so as to overlap at least one of the light emitting element or the drive element in plan view.

15. The light emitting device according to claim 14, wherein the capacitive element is provided so as to overlap both of the light emitting element and the drive element in plan view.

16. The light emitting device according to claim 15, wherein the drive wiring is provided in a first wiring layer formed on a surface of the board, and the internal wiring is provided in a second wiring layer inside the board adjacent to the first wiring layer.

17. The light emitting device according to claim 14, wherein the drive wiring is provided in a first wiring layer formed on a surface of the board, and the internal wiring is provided in a second wiring layer inside the board adjacent to the first wiring layer.

18. The light emitting device according to claim 17, wherein the capacitive element is connected to the internal wiring on an inner layer side of the second wiring layer.

19. The light emitting device according to claim 1, wherein the drive wiring is provided in a first wiring layer formed on a surface of the board, and the internal wiring is provided in a second wiring layer inside the board adjacent to the first wiring layer.

20. The light emitting device according to claim 19, wherein the capacitive element is connected to the internal wiring on an inner layer side of the second wiring layer.

* * * * *